United States Patent [19]

Legrand

[11] 4,169,629

[45] Oct. 2, 1979

[54] TUNNELING MACHINE WITH PLURAL ADJUSTABLE ARMS CARRYING SINGLE CUTTER

[76] Inventor: Marie G. J. Legrand, Koolmijnlaan 348, 3540 Zolder, Belgium

[21] Appl. No.: 886,534

[22] Filed: Mar. 14, 1978

[30] Foreign Application Priority Data

Mar. 30, 1977 [BE] Belgium ..... 255779
Nov. 3, 1977 [BE] Belgium ..... 256390

[51] Int. Cl.[2] ..... E21C 9/10

[52] U.S. Cl. ..... 299/61; 299/31; 299/80

[58] Field of Search ..... 299/56, 57, 64, 80, 299/61

[56] References Cited

U.S. PATENT DOCUMENTS 3,306,663 2/1967 Webster ..... 299/56 X
3,467,436 9/1969 Pentith et al. ..... 299/56 X
4,027,918 6/1977 Hujimori et al. ..... 299/80 X

*Primary Examiner*—Ernest R. Purser
*Attorney, Agent, or Firm*—Bacon & Thomas

[57] ABSTRACT

Machine for the digging of passages, galeries or tunnels in underground work, of the type in which the stoping device consists of a single stoping drum or mill of which the axis of rotation is practically perpendicular to the plane of the working-face, and whereby this rotary mill is attached to an arm which pivots around a shaft which is also practically perpendicular to the working-face, characterized by the fact that the latter bears in a second arm, which in its turn is attached on a shaft which is practically perpendicular to the working-face and bears in the machine frame, whereby the length of the two arms and the angles of rotation of the arms are chosen in such a manner that the mill can cover the entire surface of the working-face to be stoped, without having to move the machine laterally.

14 Claims, 8 Drawing Figures

20
22
21
1
2
3
α
16
9
6
5
A
7
19
10
18

20
22
2
1
3
6
9
5
A
7
27
19
26
23
24
25
10
18

20
21
22
2
1
3
6
9
5
A
27
7
A
19
26
23
24
25
1
10
18

20
22
1
2
3
6
9
5
β
27
A
A
7
β
26
24
19
23
25
10
18

TUNNELING MACHINE WITH PLURAL ADJUSTABLE ARMS CARRYING SINGLE CUTTER

The present invention pertains to a machine for digging passages, tunnels or galleries in underground work, and such through soft up to very hard rock, of the type in which the stoping device consists of a drum, cutter or mill, the axis of rotation of which is practically perpendicular to the working face, and whereby the cutter or mill is rotatingly attached upon a rotatable arm.

The machine according to the present invention offers various advantages with respect to existing machines, among the main ones of which we have that:

- the machine is capable of digging passages with a precise circular cross-section as well as with any other shape of cross-section;
- the cutting tools always attack the rock in the proper manner;
- in very hard rock, the digging remains possible by replacing the blades as cutting tools by discs, knurls or rolls;
- the machine does not require great external forces in the direction of the axis of the gallery during digging;
- during the digging with discs or knurls, a maximum advantage is derived from the free area of the working-face and from the stepped fitting of the discs;
- the stoping is carried out by a single drum of small dimensions with respect to the surface of the working-face, so that the required power can be kept lower. For the same reason, the necessary forces for advancing the machine during operation are smaller;
- due to the great stability of the machine, the vibrations on the cutting tools of the drum are slight;
- the supporting can be carried out quite close to the working-face;
- galleries of differing shapes and dimensions can be dug by means of the same machine;
- considering that the stoping drum moves within a plane, the desired cross-section can be cut out automatically by the use of quite simple means, whereby it also becomes possible automatically to perform corrections with respect to direction and level;
- in a certain form of embodiment, the machine also offers the following possibilities:
- to set the working-face at a certain angle with respect to the plane which is perpendicular to the longitudinal direction of the underground passage, tunnel or gallery;
- to alter and determine afore-mentioned angle of the working-face at any appropriate moment, for instance in consideration of the hardness of the rock;
- to put into practice a characteristic working process, whereby the drum penetrates almost in screw fashion in the surface of the working-face, by alternately increasing and reducing afore-mentioned slant of the working-face to be stoped with respect to the normal position of the working-face;
- to shift the cutting tool or drum forward or possibly backward over a considerable distance without having to loosen the anchorage jacks of the base structure;

- to cut out the floor, the roof and the side walls of passages or tunnels perfectly smoothy, irrespective of the fact whether the working-face to be stoped is or is not at an angle with respect to the plane which is perpendicular to the longitudinal direction of the passage or tunnel;
- to promote the stability of the working-face, which can be of importance, mainly in the case of soft rock.

The afore-mentioned as well as other advantages of this machine for digging passages and tunnels are obtained due to the fact that the machine consists mainly of a stoping drum, cutter or mill provided with cutting tools (such as blades, picks, discs, knurls or rolls, whereby the axis of rotation of the cutter is practicaly perpendicular to the plane of the working-face and whereby the cutter is attached to a first arm which can rotate around an axis which is also almost perpendicularly directed with respect to the working-face, whereby the latter bears in a second arm which in its turn is fixed on a shaft which is directed practically perpendicularly to the working-face and which bears in the machine frame, so that it becomes possible by the correct choice of the length of the two arms and of the angles of rotation of these arms, to cover the entire surface of the working-face to be stoped with a single drum of small diameter.

The angle of rotation of the mill is hereby unlimited, whereas the angles of rotation of the arms can or not be unlimited according to the form of embodiment and to the construction.

In a particular form of embodiment, the shaft of afore-mentioned drum and the shafts of afore-mentioned arms shall form a fixed, or an adjustably variable angle with respect to the imaginary axis of the passage or suchlike which is being dug by the machine.

So as to indicate the characteristics of the invention more clearly, a few forms of embodiment of the machine according to the invention shall be described hereinafter, merely as examples and without the slightest intent of limitation, with reference to the appended drawings in which.

Figure 1:
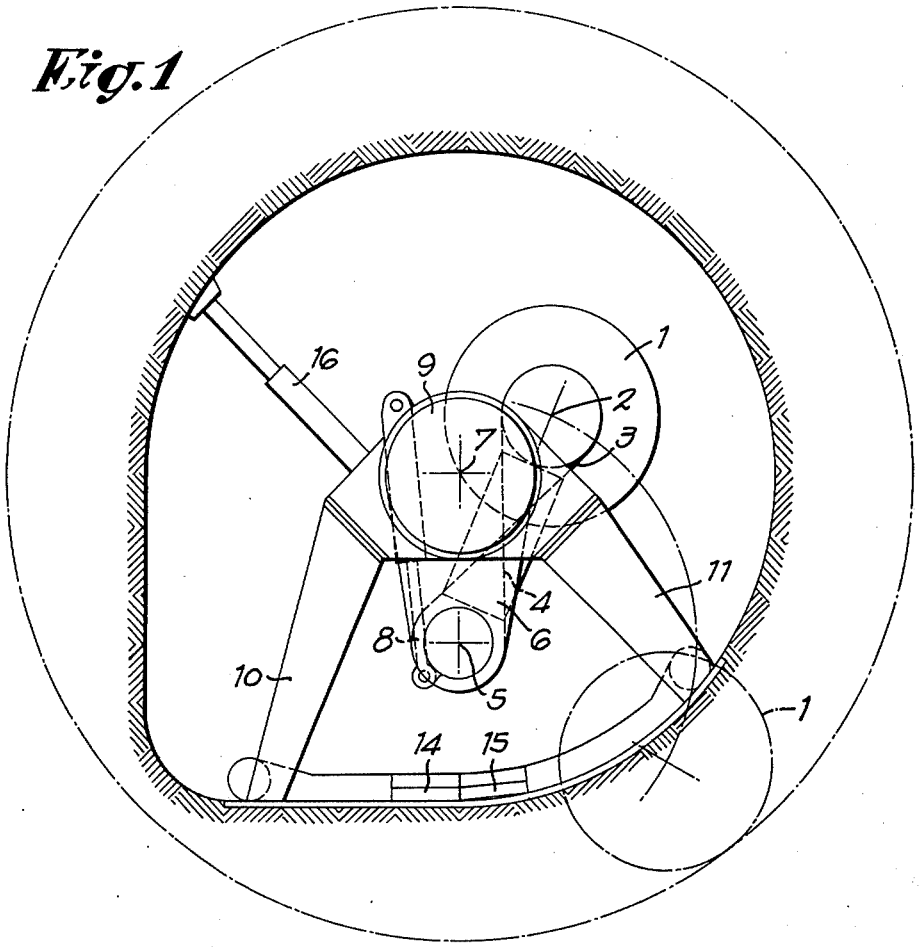
FIG. 1 shows a schematic front view of a machine according to the invention.
Figure 2:
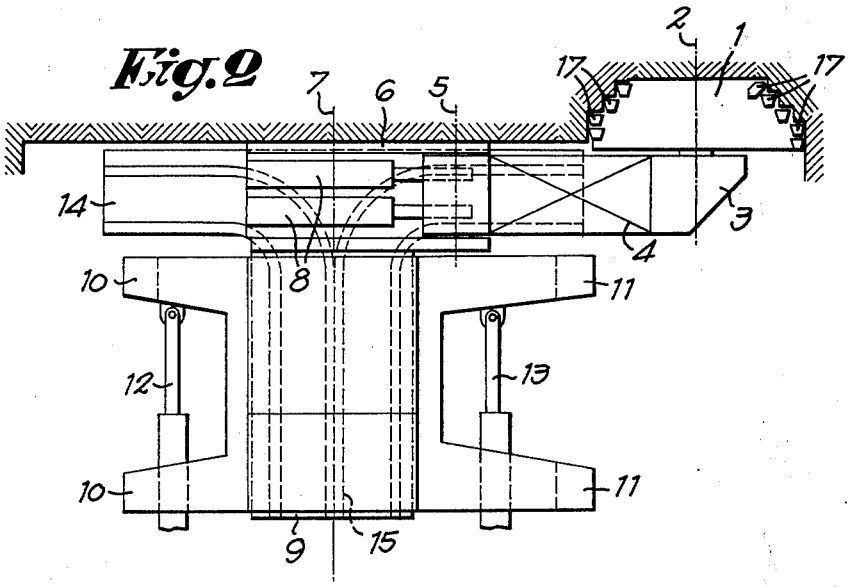
FIG. 2 shows a schematic top view of the machine of FIG. 1.

In FIGS. 1 and 2 a machine according to the invention is illustrated, whereby this machine mainly consists of a stoping drum or cutter 1 which is rotable around a shaft 2 which bears in a first arm 3, which in this form of embodiment also carries the driving motor of cutter 1, schematically indicated as 4.

Arm 3 is rotatably connected by means of a shaft 5 to a second arm 6, whereby the latter can rotate around a shaft 7.

The rotation around shaft 5 of first arm 3 with respect to second arm 6 is controlled in the form of embodiment shown by hydraulic cylinders 8, so that the angle of rotation remains limited. It is obvious that this rotation could just as well be controlled by means of a gear transmission, in which case the angle of rotation would have been unlimited.

The rotation of the second arm 6 around shaft 7 through an unlimited angle is controlled by a planetary gear system of very high torque, located within machine frame 9 which can slide forward and backward in the base structure.

In FIG. 1, a base structure 10 is drawn on the left side, such as would be used for a gallery with a horizontal floor, and a base structure 11 is drawn on the right for the case of a gallery with circular cross-section. It is obvious that the base structure may be built symmetrically or assymmetrically in accordance with the shape of the gallery.

These base structures 10 or 11 are pressed in the direction of the working-face by cylinders 12 and 13.

The above machine is completed by means of conveyors 14 or 15 and possibly by means of some gathering arms (not shown) for loading and transporting the broken down materials, as is usual in the case of mechanical digging of passages and galleries. Means are also provided for horizontally and vertically anchoring the machine, such as for instance hydraulic cylinders 16, by means of which the high reaction forces of the rock on the machine are kept in balance. The procedure during the digging of passages, galleries and tunnels by means of the above-described machine can vary widely according to the hardness of the rocks to be broken down. In soft rock the drum or cutter can be provided with sumping picks, which in the softest part of the working-face can be pressed into the rock by means of cylinders 12 or 13. By rotation of arm 6 around shaft 7, as well as the necessary rotation of arm 3 around shaft 5 with respect to arm 6, the entire working-face can be covered.

In very hard rock, the sumping penetration of the stoping drum is difficult. With machines according to the invention, the drum or cutter can be fitted for very hard rock with discs or knurls 17 as illustrated schematically in FIG. 2. In this case the penetration of the drum can take place in screw shape by swinging arms 3 and 6 around shaft 7, with rotating mill, and simultaneously sliding the machine frame 9 forward with respect to base structure 10 or 11 by means of cylinders or other means which are not shown. When the drum has penetrated sufficiently in the working-face, the entire surface must first be cut away, before the machine frame 9 is again shifted forward. After several of such steps, it shall again be required to advance base structures 10 or 11.

A simpler manner of operating consists in pressing base structure 10 (or 11) forward on the left side, at the moment when the drum is at the extreme right hand side of the working-face. The drum is next swung, for instance along the lower edge, to the left by a rotation of arms 3 and 6 around shaft 7. With the drum or cutter in its extreme left hand location, the base structure 10 (or 11) is next pressed forward on the right hand side, subsequent to which the drum is swung to the right along the top edge. We thus obtain an almost screw shaped and zig-zag shaped penetration of the mill in the working-face. After one or more turns, the remaining central core of the working-face is cut away.

Figure 3:
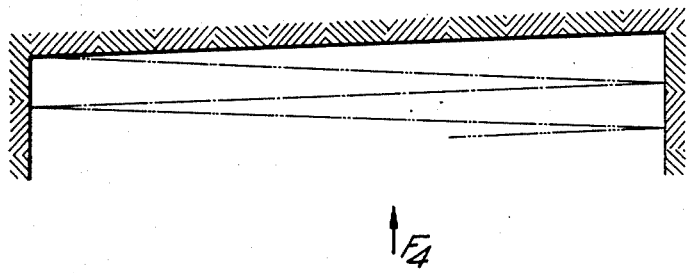
FIG. 3 shows a schematic top view of a preferred operation which can be carried out with the machine according to the invention.
Figure 4:
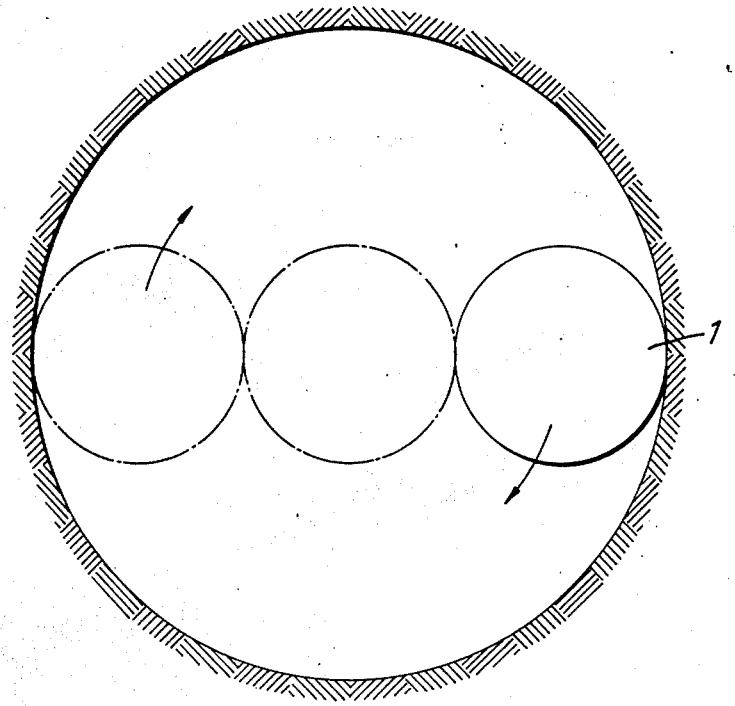
FIG. 4 is a view according to arrow F4 in FIG. 3.

This manner of operating is very schematically clarified in FIGS. 3 and 4 for the case of a circular gallery. By making use of this procedure, it is not necessary that machine frame 9 should be slidingly fitted with respect to base structure 10 (or 11), which amounts to a constructional simplification. According to the description given above, a machine is obtained for digging passages, galleries or tunnels in soils ranging from soft to very hard rock for underground work, whereby the machine offers the above stated as well as other advantages with respect to excavating machines known up till now.

Figure 5:
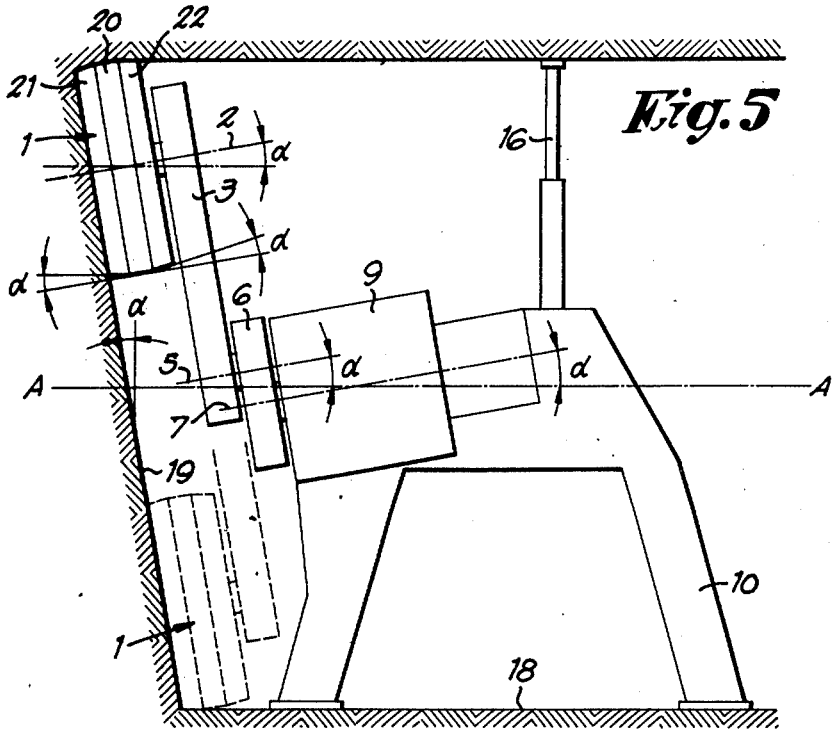
FIG. 5 shows a side view of an alternative form of embodiment of the machine according to FIGS. 1 to 4.

The machine as illustrated in FIG. 5 is provided, similarly to the previous machine, with parts 1 to 7, 9, 10 and 16, and is built in such a manner that aforementione shafts 2, 5 and 7 of arms 3 and 6 form an angle $\alpha$ with the imaginary axis A—A of the passage, gallery or tunnel 18, one and other in such a manner that the working-face 19, to which shafts 2, 5 and 7 are practically perpendicular, also forms an angle $\alpha$ with the plane which is pernpendicular to the imaginary axis A—A.

In order to obtain that the floor, as well as the roof and the side walls of passage 18 should be worked smooth, the cutter or stoping drum 1 is made up of three main parts, namely a central cylindrical part 20 and two conical parts, respectively 21 and 22, which are each other's reflected image, and the conicity of which is equal to afore-mentioned angle $\alpha$.

Figure 6:
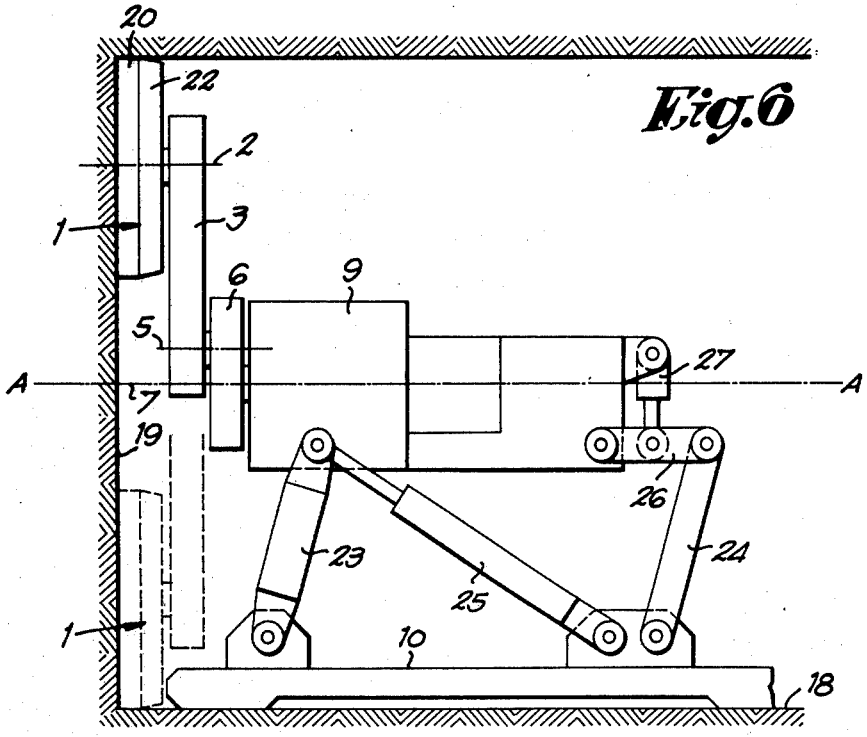
FIG. 6 shows an alternative to FIG. 5.
Figure 7:
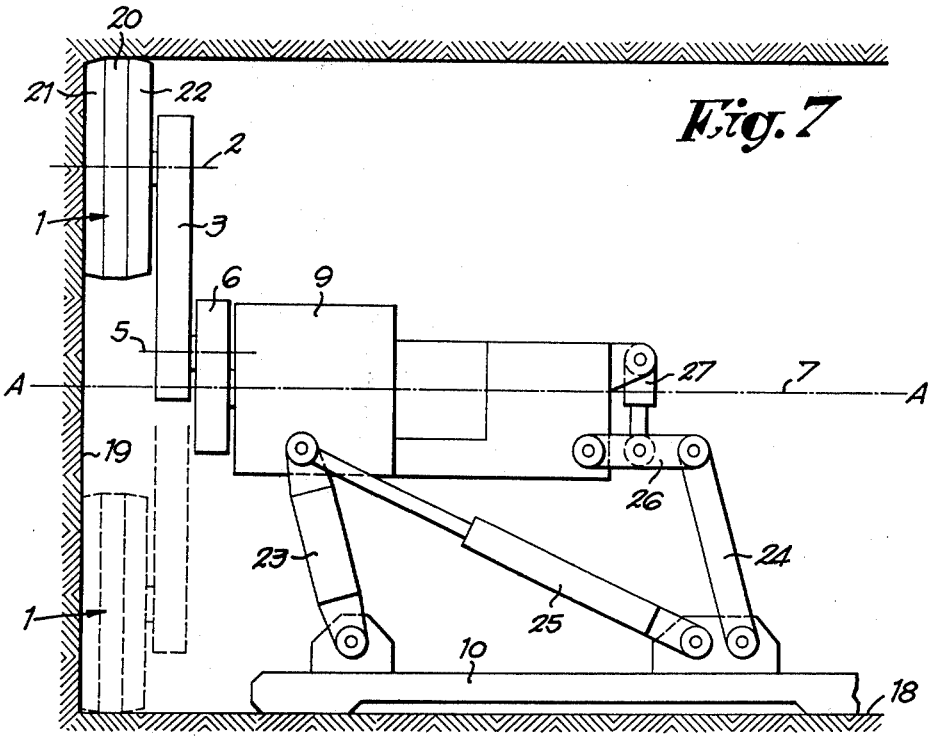
FIG. 7 is a view which is similar to that of FIG. 6, but for a second characteristic position of the machine frame.
Figure 8:
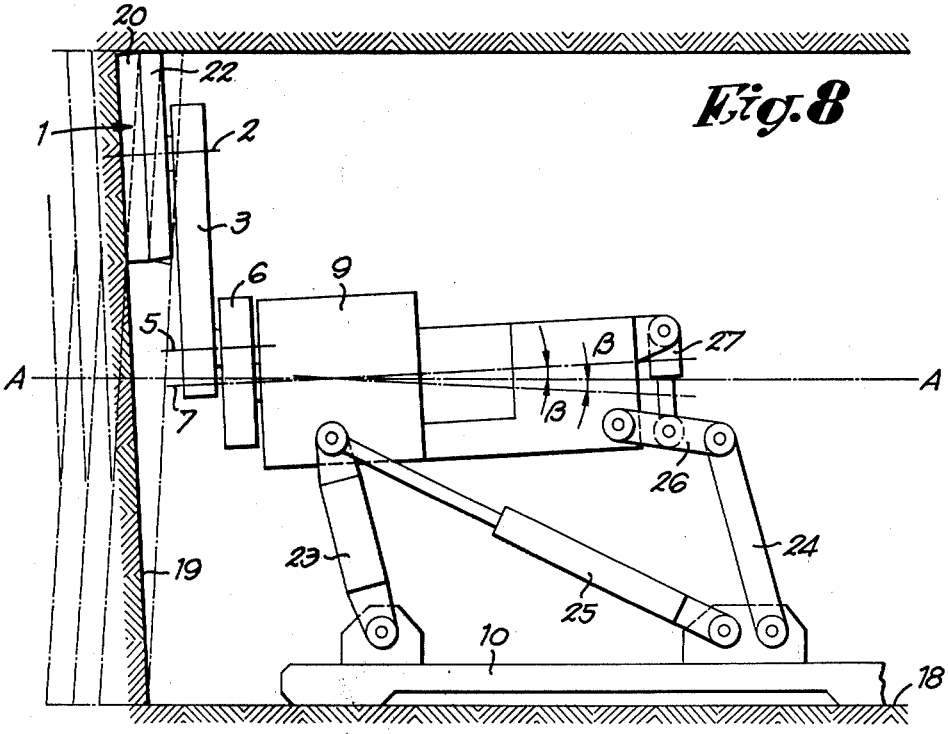
FIG. 8 shows a view which is similar to that of FIG. 7, but for two operating positions of the improved machine according to the invention, when using a characteristic mode of operation.

In FIGS. 6 to 8, an alternative form of embodiment to that of FIG. 5 is illustrated.

The mill 1 can hereby be carried out as shown in FIGS. 5 and 7, or in the form illustrated in FIGS. 6 and 8, or even in any other form whatever, for instance such as illustrated in FIG. 2.

According to the invention, machine frame 9 is connected to the base structure 10 by means of two pairs of rods, respectively 23 and 24, which are on the one hand hingedly attached to base structure 10, and on the other hand hingedly attached to machine frame 9, so as to obtain a quadrangle or a parallelogram of rods which permits machine frame 9 to be moved parallel to itself over a relatively large distance, forward or backward, with respect to working-face 19, without having to move base structure 10. As particular case, the linking can be carried out in such a manner that the machine frame performs a translation in straight line with respect to the base structure.

This forward or backward movement of machine frame 9 with respect to base structure 10 is obtained for instance by means of a hydraulic pressure cylinder 25, which is fitted between machine frame 9 and base structure 10.

For the purpose of altering angle $\beta$ between axis 7 and direction A—A of the tunnel or passage during the operation of the machine, the length of the rods of afore-mentioned quadrangle of rods may be increased or reduced, or the location of the hinge shafts of the quadrangle of rods may be altered in the base structure or in the machine frame. FIG. 6 shows as example one of the many forms of embodiment which satisfy the stated requirements. The pair of rods 24 is linked to machine frame 9 by means of a pair of levers 26, whereby the latter can be moved up and down by means of cylinders 27. It is obvious, that by operating pressure cylinders 27, the angle $\beta$ between axis 7 and the direction A—A can be adjusted at will.

If angle $\beta$ is maintained constant during the stoping, a slanting working-face is obtained, as illustrated also in FIG. 5.

If in the course of the stoping of the working-face cylinder 27 is alternately operated in one direction and in the other, each time the drum is in its bottom or top position, it becomes possible by simultaneously operating cylinder 25, to obtain a practically screw shaped penetration of the drum. This characteristic procedure of almost screw shaped penetration into the working-face offers the advantage, that in the course of the stoping of each half of the working-face, the picks, blades or knurls always operate in the same even plane. When stoping hard rock, this purely radial penetration of the picks, blades, knurls or discs offers great advantages with respect to efficiency and wear. For this procedure, the drums or mills need moreover not be provided with sumping picks or blades or frontal knurls in order to permit a frontal penetration of the drum in the rock. The forces required in order to make these blades or knurls penetrate frontally therefore also become superfluous.

In order to reduce the perpendicular forces upon the working-face, the angles of relief of the knurls and of the drum have to be chosen judiciously.

For this purpose, the drum 1 and its drive can be connected to arm 3 by means of a universal transmission in such a way that for any sense of rotation of arms 3 and 6 the right angle of relief may be set, by means of cylinders for instance.

It is obvious that the present invention is by no means limited to the form of embodiment described as example and illustrated in the appended drawings, but that such a machine can be built in all sorts of shapes and dimensions without going beyond the scope of the invention.

What I claim is:

1. Machine for the digging of passages, galeries or tunnels in underground work, of the type in which the stoping device consists of a single rotary cutter of which the axis of rotation is generally perpendicular to the plane of the working-face, said rotary cutter being mounted on a first arm which pivots around an axis which is also generally perpendicular to the working-face, said first arm being journalled about said axis on a second arm, which in turn is attached on a shaft which is generally perpendicular to the working-face and bears in the machine frame, the length of the two arms and the angles of rotation of the arms being selected so that the mill can cover the entire surface of the working-face to be stoped, without having to move the machine laterally.

2. Machine according to claim 1, characterized by the fact that the angle of rotation of the first arm with respect to the second arm is limited, whereas the angle of rotation of the second arm with respect to the machine frame is unlimited.

3. Machine according to claim 1, characterized by the fact that the angle of rotation of the first arm with respect to the second arm is unlimited.

4. Machine according to claim 1, characterized by the fact that the driving motor of the rotary cutter is mounted on the first arm and consequently performs all movements with same.

5. Machine according claim 1, characterized by the fact that the axis of afore-mentioned cutter and the axes of rotation of said arms form an angle with the imaginary center line of the passage or tunnel which is being dug by the machine.

6. Machine according to claim 5, characterized by the fact that the angle between the axes of the cutter and of the arms, on the one hand, and the center line of the passage or tunnel, on the other hand, can be adjusted at will and during the operation of the machine.

7. Machine according to claim 5 or 6, characterized by the fact that the surface of revolution of the rotary cutter is formed by a cylindrical part which is provided at each end with a conical part, whereby the conical parts are the reflected image of each other.

8. Machine according to claim 5 or 6, characterized by the fact that the cone angle of afore-mentioned conical parts of the rotary cutter is substantially equal to the selected angle between the axis of said cutter and the imaginary center line of the passage or tunnel.

9. Machine according to claim 6, characterized by the fact that the connection between machine frame and base structure consists of two pairs of hinging rods which, together with the base structure and the machine frame, form a parallelogram of rods.

10. Machine according to claim 9, characterized by the fact that hydraulic cylinders are provided between the machine frame and the base structure, which permit the shifting forward of the machine frame with respect to the base structure.

11. Machine according to claim 9, characterized by the fact that the length of at least one of the rods of the parallelogram is variable, in order to be able to alter the angle between the shafts of the arms, the mill and the machine frame, on the one hand, and the direction of the passage or tunnel, on the other hand.

12. Machine according to claim 9, characterized by the fact that at least one of the axes of rotation of afore-mentioned parallelogram of rods can be moved in order to alter the angle between the shafts of arms, cutter and machine frame, on the one hand, and the direction of the passage or tunnel, on the other hand.

13. Machine according to claim 12, characterized by the fact that one of afore-mentioned pairs of rods is hingedly attached to the end of a lever which is hingedly attached at its other end to the machine frame, and whereby means are provided which permit placing afore-mentioned lever at an angle with respect to the machine frame.

14. Machine according to claim 13, characterized by the fact that the last-named means consist of a hydraulic cylinder which is fitted hingedly between aforesaid lever and the machine frame.

* * * * *